US006093080A

United States Patent [19]

Inaba et al.

[11] Patent Number: 6,093,080

[45] Date of Patent: Jul. 25, 2000

[54] POLISHING APPARATUS AND METHOD

[75] Inventors: Shoichi Inaba; Takao Katsuyama; Morimitsu Tanaka, all of Tokyo, Japan

[73] Assignee: NEC Corporation, Tokyo, Japan

[21] Appl. No.: 09/245,881

[22] Filed: Feb. 8, 1999

[30] Foreign Application Priority Data

May 19, 1998 [JP] Japan ..... 10-153889

[51] Int. Cl.[7] ..... B24B 49/00; B24B 51/00

[52] U.S. Cl. ..... 451/5; 451/9; 451/287; 451/443

[58] Field of Search ..... 451/5, 8, 9, 11, 451/21, 28, 56, 443, 444, 285, 287, 288, 41

[56] References Cited

U.S. PATENT DOCUMENTS

| | | | |
|---|---|---|---|
| 5,036,015 | 7/1991 | Sandhu et al. | 451/41 |
| 5,639,388 | 6/1997 | Kimura et al. | 451/41 |
| 5,743,784 | 4/1998 | Birang et al. | 451/21 |
| 5,904,608 | 5/1999 | Watanabe | 451/5 |
| 5,904,609 | 5/1999 | Fukuroda et al. | 451/8 |

FOREIGN PATENT DOCUMENTS 10-15807 1/1998 Japan .

10-315124 12/1998 Japan .

OTHER PUBLICATIONS

S. Inaba et al., "Study of CMP Polishing Pad Control Method", 1998 Proceedings Third International Chemical–Mechanical Planarization for ULSI Multilevel Interconnection Conference (CMP–MIC), Feb. 19 1998, pages: No Page Numbering.

S. Inaba, et al., "Study of CMP Polishing Pad Control Method", 1998 Proceedings Third International Chemical–Mechanical Planarization for ULSI Multilevel Interconnection Conference (CMP–MIC), Feb. 19, 1998, pp. 44–51.

*Primary Examiner*—Derris H. Banks

[57] ABSTRACT

A polishing apparatus and method capable of polishing stably irrelevant of disorder such as the change of a polishing object, change of a polishing device with lapse of time. A polishing apparatus includes polishing pad 1, polishing table 3 with the polishing pad adhered thereto, table motor 8 for driving the polishing table 3, conditioning device 5 of the polishing pad 1 and conditioning control system 12 for setting conditioning conditions. According to a polishing method of the present invention, conditioning conditions of the polishing pad 1 are set on based on a frictional force exerted between the polishing pad 1 and a substrate or on torque current 10.

13 Claims, 11 Drawing Sheets

POLISHING APPARATUS AND METHOD

FIELD OF THE INVENTION

The present invention relates to polishing apparatus and method, more especially to polishing apparatus and method for polishing a substrate.

BACKGROUND ART

FIGS. 12 (A) and 12 (B) show a conventional polishing apparatus for polishing a wafer (substrate). Referring to FIGS. 12 (A) and 12 (B), according to the conventional polishing apparatus, a wafer 2 is polished through the steps of dropping a droplet of a slurry, which contains an abrasive agent and which is fed from a slurry feed means 6, on a polishing pad 1 adhered to a rotatable polishing table 3, pressing the wafer 2 rotated by a spindle 7 against the polishing pad. In order to remove debris and the like which clog traps (grooves) formed on the surface of the polishing pad 1, conditioning of a polishing pad (called as to "Ex-SITU conditioning") is performed by using a diamond disc 5 installed on a conditioning drive means 4 during the interval between polishing steps (runs).

Conventionally, conditioning conditions have been determined by practicing a pilot operation before advancing an actual polishing step of polishing a wafer to be changed into a product. Explaining more in detail, according to the prior method, a conditioning condition is set as follows. Many pilots (blank wafers) are polished changing the conditioning time. The thickness of each pilot is measured after a given time of polishing. When the pilot thickness coincides with the set thickness, the corresponding conditioning time is taken as a conditioning condition. In case of polishing wafers belonging to the same lot group or the same patterned group, the above pilot procedure by using one blank wafer per several ten pieces of lots is taken, and the conditioning time is determined on the result of this procedure.

SUMMARY OF THE DISCLOSURE

However, in the course of the investigations toward the present invention the following problems have been encountered. Namely, the following problems are involved in the aforementioned prior art. The first problem is to perform a pilot operation on the same conditioning condition in the next operation, i.e., without changing conditioning conditions in one and next pilot operations. As a result, a polishing speed varies at every run performed in one and next pilot operations due to disorder such as the change of a polishing pad in its surface state, variation between lots, ununiformity of an abrasive agent and the like. Consequently, it is in fear of polishing a wafer excessively.

The second problem is to require the determination of conditioning conditions (or make of a recipe) for every different part in properties by correspondingly performing the pilot operations according to the conventional method of setting conditioning conditions, since the degree of lowering a polishing efficiency due to the fatigue of a polishing pad, clogging and the like changes depending on the kind of polishing object (kind of film and the like) and the device pattern formed on a wafer.

Accordingly, an object of the present invention is to provide a polishing apparatus and method capable of stably polishing a substrate in spite of the difference in the polishing object and the change in a polishing device with lapse of time.

Further objects of the present invention will become apparent in the entire disclosure.

In a first aspect of the present invention, there is provided a polishing apparatus which comprises a polishing device for polishing a substrate, a conditioning device for conditioning the polishing device before polishing the substrate and a conditioning control system which controls the conditioning device based on a frictional force exerted between the polishing device and the substrate during polishing the substrate.

In a second aspect of the present invention, the conditioning control system is capable of controlling the conditioning device so as to make the frictional force constant. In a third aspect of the present invention, the conditioning control system is capable of controlling the conditioning device based on a torque current which is a signal corresponding to the frictional force and which drives the polishing device.

In a forth aspect of the present invention, the conditioning is performed in the interval of polishing steps (hereinafter referred as to "runs") of polishing the substrate, a polishing apparatus of the present invention further comprises a torque current detection unit which detects the torque current signal and outputting the same to the conditioning control system, and the conditioning control system comprises a setting unit which sets conditioning conditions so as to make the maximum of the torque current constant mutually in the polishing steps based on a detection signal input from the torque current detection unit.

In a fifth aspect of the invention, the conditioning is performed in the interval of polishing steps (hereinafter referred as to "runs") of polishing the substrate, a polishing apparatus of the present invention further comprises a torque current detection unit for detecting the torque current signal and outputting the same to the conditioning control system, and the conditioning control system comprises a setting unit for setting conditioning conditions so as to keep the sum of the torque current flowing during polishing the substrate constant mutually throughout the polishing steps based on a detection signal input from the torque current detection unit.

In a sixth aspect of the present invention, the conditioning conditions are set by a setting unit based on one or more conditioning load of the conditioning device working on the polishing device, number of revolution of the polishing device during conditioning, conditioning time and surface roughness of the conditioning device.

In a seventh aspect of the present invention, the setting unit is capable of setting a conditioning load based on the variation amount (difference) of the maximum torque currents each observed in plurality of polishing steps and further based on a conditioning load of a preceding polishing step.

In an eighth aspect of the present invention, the polishing device comprises a polishing table having a polishing pad adhered thereto on which traps for capturing abrasive grains or debris are formed, the relation of the frictional force $\mu(t)$ after t hours lapsed from the start of polishing and conditioning conditions is represented by the following formula:

$$\mu(t)=n\times h\times X\times r(t)$$

where n is the number of traps on the polishing pad, h is the depth of the traps, X is the width of the traps, r(t) is the effective trap ratio which contributes to polishing and corresponds to a value which decreases with lapse of time due to gradual loading of debris in the traps.

In a ninth aspect of the present invention, there is provided a polishing method which comprises the steps of: detecting a frictional force acting on between a polishing device and a substrate during polishing the substrate; conditioning the polishing device based on the frictional force detected; and advancing a subsequent step of polishing the substrate.

In a tenth aspect of the present invention, there is provided a polishing method which comprises the steps of: detecting a torque current which drives a polishing device for polishing a substrate during polishing the substrate; conditioning the polishing device based on the torque current; and advancing a subsequent step of polishing the substrate.

In an eleventh aspect of the present invention, the maximum value of the torque current is detected in polishing steps (hereinafter referred as to "runs") of a substrate, conditioning conditions are set based on the variation amount (difference) in the maximum torque currents observed in the polishing steps (hereinafter referred as to "runs") and of conditioning conditions of a preceding polishing step. In one polishing step (run) of the substrate, one or more substrates are polished.

According to the present invention, information for setting conditioning conditions of a polishing device can be obtained during polishing a substrate so that it is needless to perform a pilot operation for obtaining the conditioning conditions in the interval of the runs. Further, even when properties of a substrate (for example, device pattern and kind of film) are partially different, local (partial) information corresponding to the partial properties can be obtained during polishing the substrate so that it is easy to set optimum conditioning conditions which are locally different part by part according to the information.

Moreover, the information for setting the conditioning conditions of the polishing device can be obtained during polishing the substrate which is to be changed into a product, and these information is fed back to a conditioning control system. Consequently, conditioning conditions can be set appropriately and immediately against disorder such as the variation of lots, the difference of a pattern on the substrate, the change of the polishing device with lapse of time and the like. Accordingly, polishing speed and total polished amount can be sufficiently stabilized only by controlling a time.

BRIEF DESCRIPTION OF DRAWINGS

FIGS. 4(A) and (B) are an explanatory view of the surface state change of a polishing pad due to polishing. FIG. 4 (B), the sate after polishing.

PREFERRED EMBODIMENTS OF THE INVENTION

The preferred embodiments of the present invention will be explained with reference to the accompanying drawings.

Figure 2:
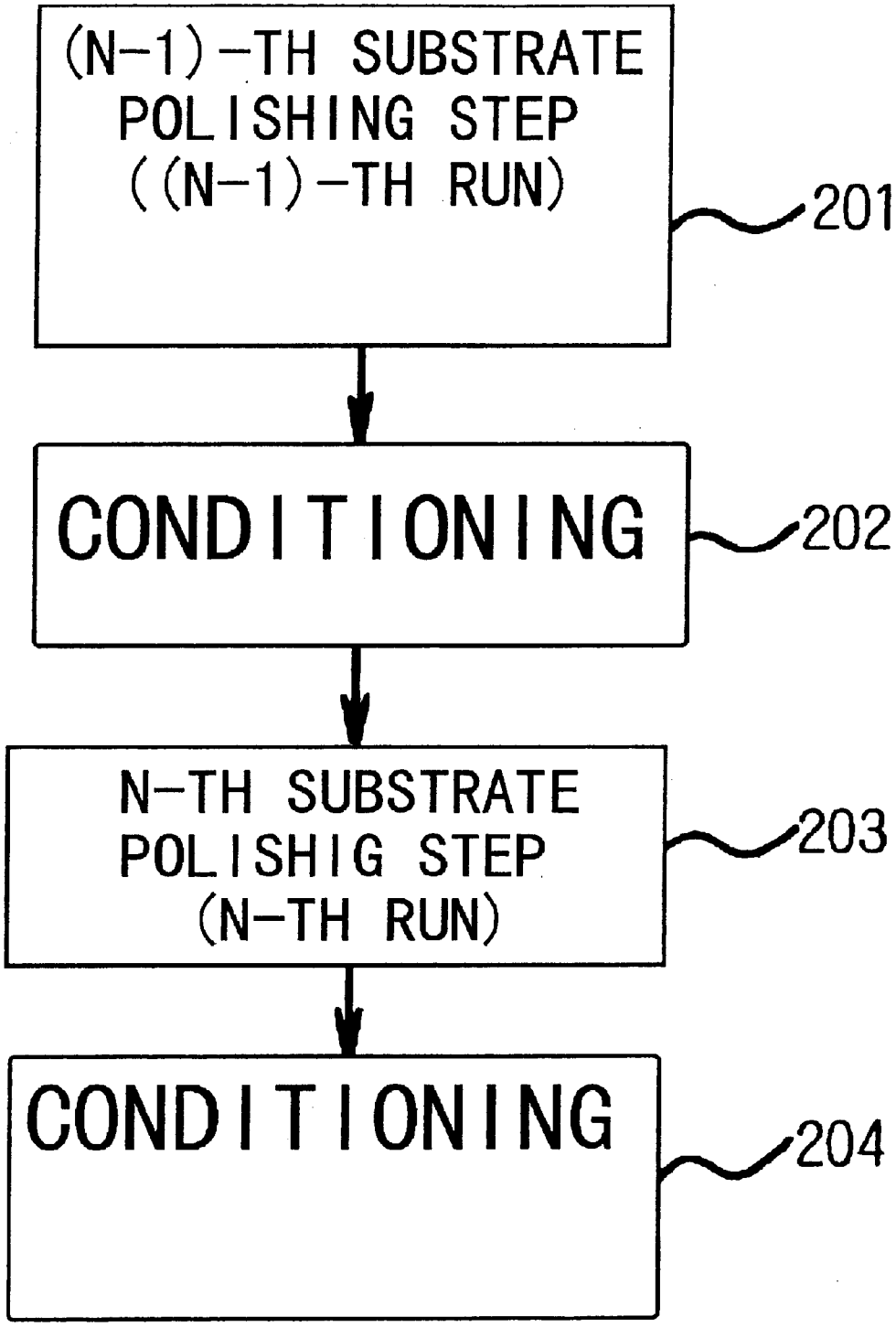
FIG. 2 shows a polishing sequence in case of applying Ex-SITU conditioning.

In the present invention, "Ex-SITU conditioning", that is the conditioning of a polishing device carried out between polishing steps (runs), FIG. 2 is an explanatory view showing a polishing sequence in which the Ex-SITU conditioning is applied. As shown in FIG. 2, (n−1)-th run is carried out in this polishing sequence while single or plural substrates are mounted on a polishing apparatus (step 201). Next, the conditioning of a polishing device and the like is carried out by using a conditioning device such as diamond grinding wheel, brush and the like (step 202). Then, n-th run is carried out (203), and the conditioning is carried out after the finish of the n-th run (step 204).

Figure 1:
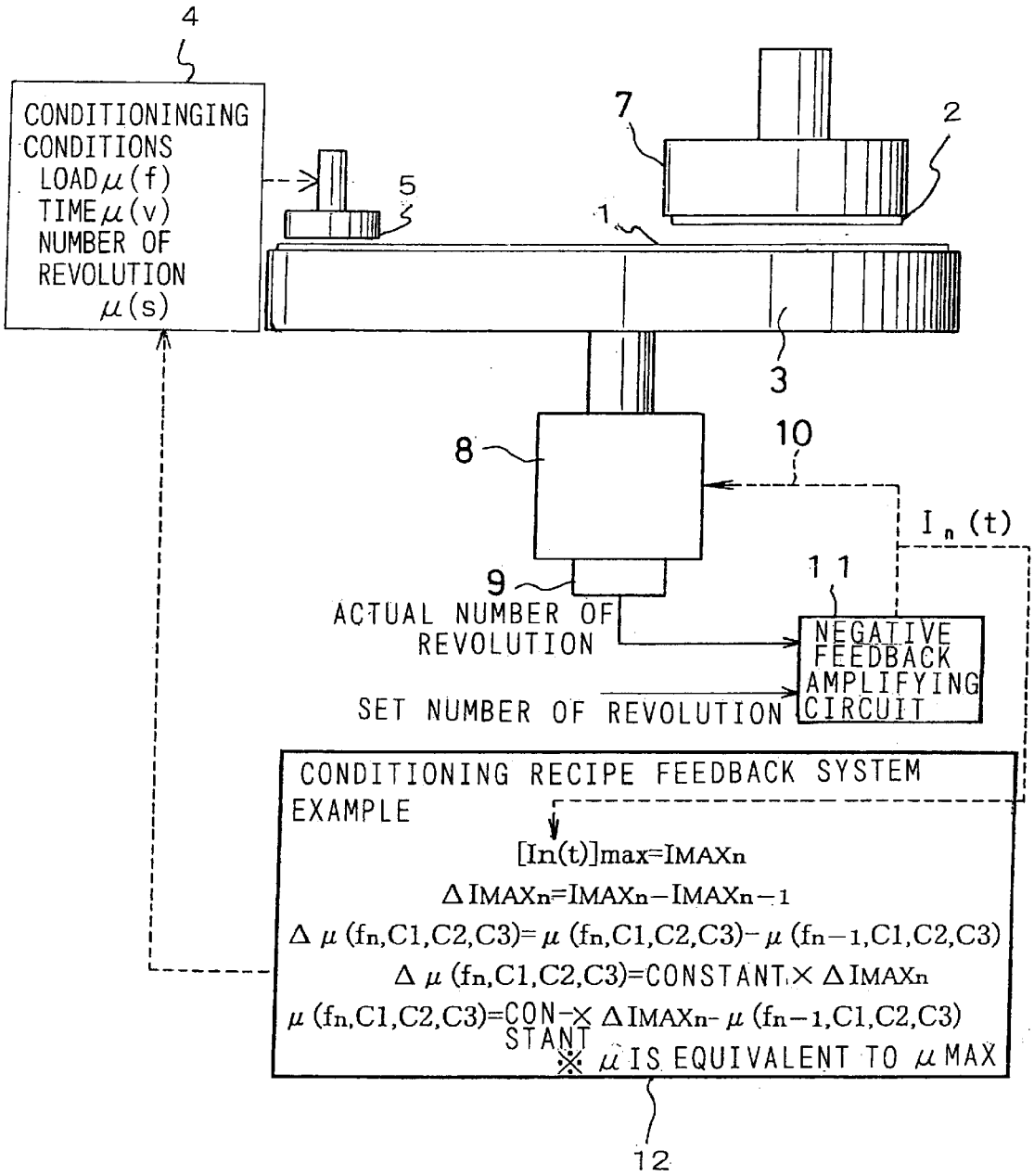
FIG. 1 is a view showing an exemplary polishing apparatus of the present invention.

Here, a wafer is polished with a polishing pad, on which the Ex-SITU conditioning was carried out, by using a polishing apparatus shown in FIG. 1. Details of the apparatus will be explained in the paragraph of Example. The result regarding the change of a polishing speed (removal rate) measured under the following polishing condition with time is shown in FIG. 3.

Polishing condition (polishing load: 7 psi, number of revolution of a polishing table: 20 rpm, number of revolution of a spindle: 20 rpm, flow rate of a slurry: 100 cc/min., conditioning condition, number of revolution of a polishing table: 20 rpm, conditioning time: 2.2 sec×20 sector=44 sec, diamond disc: 4 inch -#100 diamond, slurry SS-25: pure water =1:1, polishing pad: IC-1000-Suba 400, wafer for polishing: 10000 AP/TEOS film).

Figure 3:
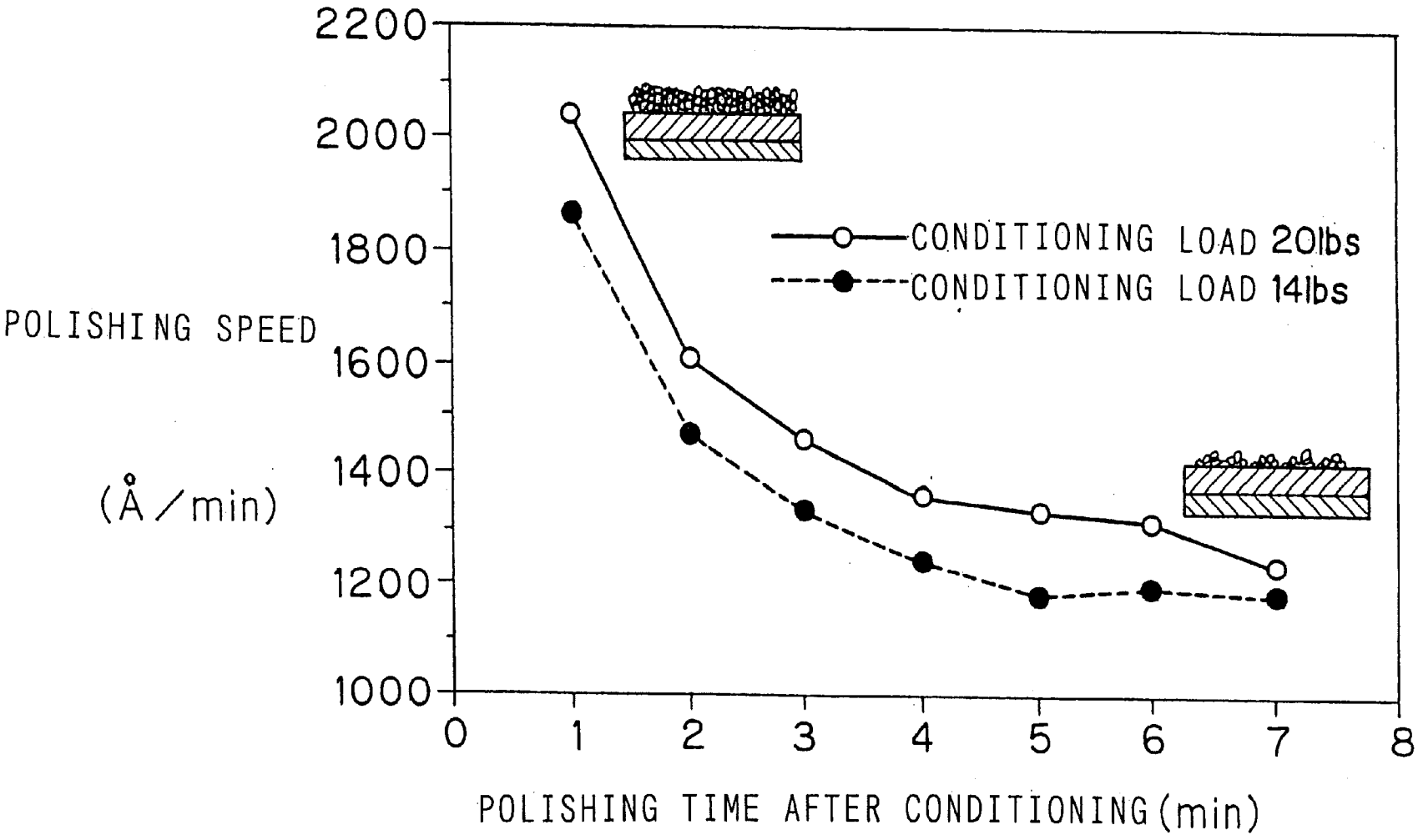
FIG. 3 is a graph for explaining the change of a polishing speed with time in the polishing step after Ex-SITU conditioning.

As shown in FIG. 3, in the polishing process of a wafer after the Ex-SITU conditioning of the polishing pad, a polishing speed (Angstroms/min. ) tends to decrease gradually with lapse of time and becomes constant after the lapse of a certain period of time. Then, the present inventors proposed a model which indicates the change of the surface state of the polishing pad in the midway of polishing as shown in FIGS. 4(A) and 4(B) in order to find the reason why the polishing speed changes as shown in FIG. 3.

Figure 4:
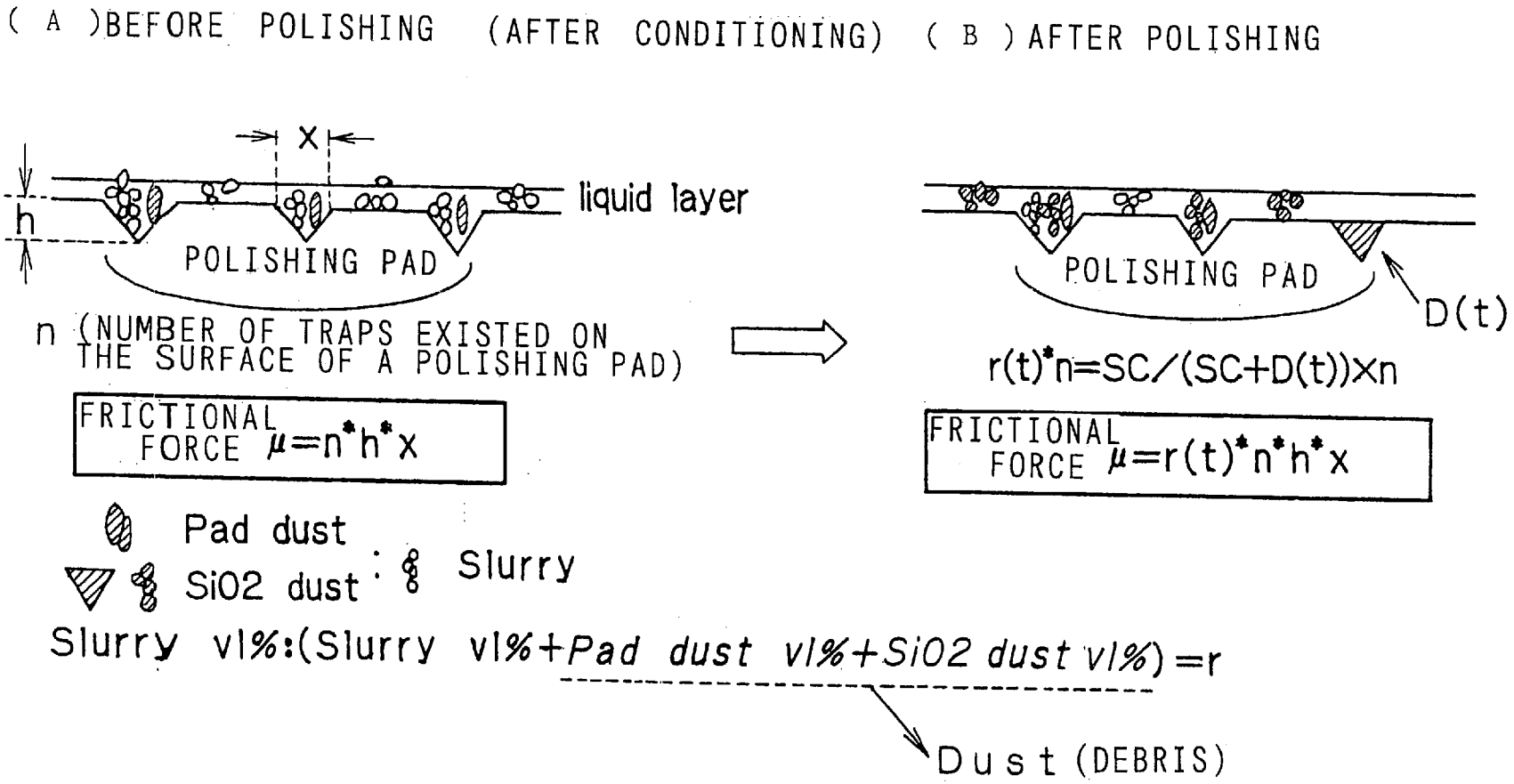
FIG. 4 (A) shows the sate before polishing.

FIG. 4 (A) shows the surface state of the polishing pad immediately after conditioning. Referring to FIG. 4 (A), if it is supposed that all of the traps (grooves which hold abrasive grains) existed on the polishing pad works efficiently or ideally just after conditioning, a frictional force $\mu$ acting on between the polishing pad and a substrate during polishing the substrate immediately after conditioning can be represented by "$\mu = n \times h \times X$". Here, n, h and X represent parameters which show the initial state of the polishing pad immediately after conditioning, and n is an effective number of traps existed on the polishing pad in the initial state; h, an effective depth of the trap in the initial state; and X, an effective width of the trap in the initial state.

FIG. 4 (B) shows the surface state of the polishing pad immediately after polishing the substrate. As shown in FIG. 4 (B), polishing the substrate generates polishing pad dust (Pad dust) and substrate debris (dust of polished substrate) such as SiO2 dust. Here, a slurry density, which actually contributes to polishing, decreases with the lapse of polishing time. When an initial density of a slurry before polishing is SC, and a dust density after t hours lapsed from the start of polishing is D(t), an effective slurry density after t hours lapsed from the start of polishing can be represented by SC/{SC+D(t)}.

Then, the traps on the surface of the polishing pad is gradually loaded by the generated dust. Accordingly, when a ratio of effective traps which actually contribute to polishing after t hours lapsed from the start of polishing is r(t), the effective trap ratio r(t) can be represented by r(t)=SC/{SC+D(t)}. Therefore, an effective number of traps which the polishing pad has after t hours can be represented by "r(t)×n=SC/{SC+D(t)}×n".

Consequently, a frictional force $\mu$ acting on between the polishing pad and the substrate after t hours lapsed from the start of polishing can be represented by "$\mu$(t)=n×h×X". Here, the effective depth, width and the like of the traps in the initial state can be changed by the conditioning conditions before polishing the substrate. Accordingly, it will be understood that the frictional force generating between the polishing pad and the substrate during polishing the substrate can be controlled.

Figure 5:
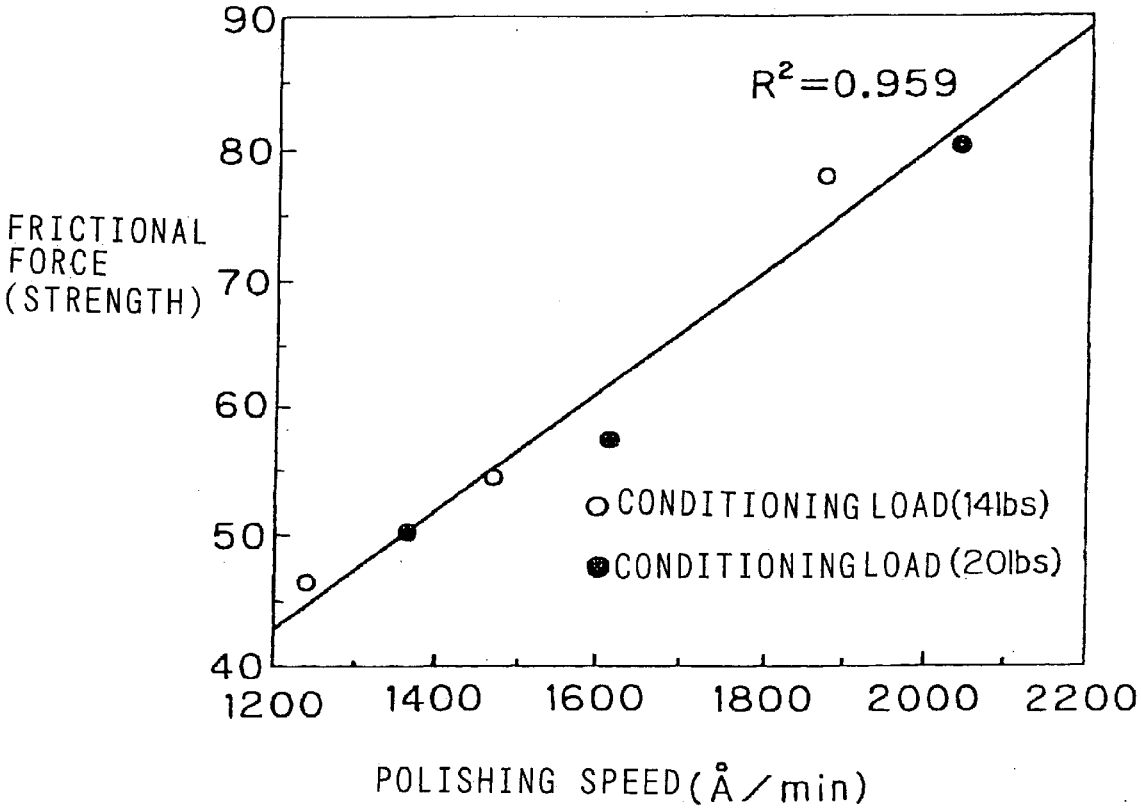
FIG. 5 is a graph showing the relation of a polishing speed and a frictional force.

From the aforementioned measurement result shown in FIG. 3, the relationship regarding the polishing speed of the substrate and the frictional force acting on between the polishing pad and the substrate was further determined. FIG. 5 is a graph showing the relationship of the polishing speed and the frictional force. As shown in FIG. 5, there is high correlation ($R^2$=0.959) between them. Accordingly, it will be understood that the frictional force acting on between the polishing device and the substrate as well as the substrate polishing speed can be controlled by changing conditions of the conditioning which is to be practiced before polishing the substrate. For example, conditions of the conditioning to be practiced before a run can be set so as to substantially coincide the maximum polishing speed in one run with that in other run. Otherwise, the conditioning conditions can be set so as to make the sum of the frictional force generating during a run constant mutually in each of the runs. Such controlling the polishing speed will result in preventing the delay of polishing due to the lowering of the polishing speed, damage of the substrate due to the rise of the polishing speed and the like as well as improving the yield of products on account that the substrate can be polished steadily on the constant conditions.

The following is the explanation of a method for setting conditioning conditions according to one embodiment of the present invention. In this embodiment, conditioning conditions are set on the basis of a torque current (hereinafter referred as to "polishing table torque current"), which is supplied to a motor for driving a polishing table, by using a polishing table with a polishing pad adhered thereto as a polishing device and a diamond grinding wheel as a conditioning device.

In the polishing table torque current, each of instant torque current I(t) and the sum of the torque current ΣI(t) (or integrated value) closely correlates to the polishing speed and the sum of the polished amount, and can be represented by the following formula.

$$I(t)=A\times\text{instant polishing speed} \quad (1)\ (A\text{: constant})$$

$$\Sigma I(t)=A\times\text{total polished amount} \quad (2)\ (A\text{: constant})$$

The above formula (1) indicates that the instant polishing speed is controllable on the basis of the instant torque current I(t). And, the above formula (2) indicates that the total polished amount is controllable on the basis of the sum of the torque current running during polishing. The relation of conditioning conditions and polishing speed, polished amount will be explained as follows.

As explained above in reference to FIG. 4 (A), the frictional force $\mu$ acting on between the polishing pad and the wafer can be represented by "$\mu$=n×h×X" when all of the traps existed on the polishing pad works efficiently or ideally just after conditioning (before polishing). Here, n is number of traps; h, trap depth; and X, trap width.

On the other hand, an effective trap number r(t)×n after t hours lapsed from the start of polishing can be represented by "r(t)×n=SC/{SC+D(t)}×n" as explained above with reference to FIG. 4 (B). Here, SC is an effective number of traps; D(t), number of traps which are loaded after the lapse of t hours. Accordingly, the frictional force after t hours lapsed from the start of polishing can be represented by the following formula.

$$\mu(t)=n\times h\times X\times r(t) \quad (3)$$

In the above formula (3), n is number of traps existed on the polishing pad; h, effective depth of trap; X, effective width of trap; and r(t), effective trap ratio.

The above parameters n, h and X are determined by the Ex-SITU conditioning conditions before polishing. Accordingly, the following equation is established.

$$n=B\times s\times v \quad (4)\ (B\text{: constant})$$

In the above formula (4), s (variable) is number of revolution of a table during conditioning; v (variable), sector residence time (sweep time). Here, the term "sector" means a surface area resulting from sectioning the surface of the polishing pad into a plurality of pieces; the term "sector residence time", a time required for conditioning a certain sector.

$$h=C\times f\times d \quad (5)\ (C\text{: constant})$$

$$X=D\times d \quad (6)\ (D\text{: constant})$$

In the above formula (5), f is conditioning load, and in the above formula (6), d is grain size of diamonds contained in a diamond disc.

The formula (3) can be transformed as follows.

$$\text{Frictional force } \mu(t)=\text{constant}\times fsvd\times r(t) \quad (7)$$

In the above formula, "fsvd" represents a function F(f,s, v,d) in which f, s, v and d are variables.

In the above formula (7), r(t) is a damping equation which exhibits damping with the increase of "t" (cf. FIG. 3). Accordingly, the following formula is derived from the formula (7).

$$\text{MAX}\ (\mu(t))=\mu\text{MAX}=\text{constant}\times fsvd \quad (8)$$

Here, the polishing table torque current for driving the polishing table at a constant number of revolution is proportional to the frictional force. Accordingly, the following formula is derived from the formula (8).

$$\text{Maximum torque current I MAX}=\text{constant}\times\mu\text{MAX}=\text{constant}\times fsvd \quad (9)$$

The above formula (9) indicates that the maximum torque current I MAX is changed by changing one or more of conditioning conditions (f, s. v or d). Accordingly, it will be understood that the maximum torque current can be controlled to be invariable by changing one or more of the conditioning condition on the basis of the formula (9), and consequently that the maximum torque current can be controlled to be mutually constant common through the polishing steps (runs), Further, the difference of the total polished amount between the polishing steps can be minimized (or stabilized).

In the above embodiment, conditioning conditions are set so as to make the maximum value of the polishing table torque current constant. However, the conditioning conditions may be set in this place so as to the integrated value (sum) of the polishing table torque current flowing during polishing the substrate mutually constant common through the runs. As a result, the total polished amount of the substrate can be controlled so as to become mutually constant common through the runs.

In the present invention, a control signal of a motor for driving the polishing table or a signal corresponding to the number of revolution of the polishing table or the motor may be applied as a signal which is substantially proportional to the frictional force. Conditioning conditions can be set by using, for example, a polishing table, to which a polishing pad is adhered and which is driven by using a direct-current motor whose number of revolution is controlled to be constant, is used as a polishing device on the basis of a torque current flowing in the direct-current motor or of a control signal of this direct-current motor.

A conditioning control system may be composed of a circuit into which the polishing table torque current is input, which operates or calculates on the basis of the input signal to set conditioning conditions, and from which a control signal corresponding to the set conditioning conditions is output.

The conditioning conditions to be set include, for example, load of a conditioning device against the polishing device, number of revolution of the polishing device during conditioning, conditioning time and roughness of the conditioning device. As the conditioning device, grinding wheel, brush or other dresser can be used. The conditioning conditions can be changed by adjusting grain size and/or hardness of abrasive grains in case of using a grinding wheel, or by adjusting diameter and/or hardness of brush hairs in case of using a brush.

Figure 6:
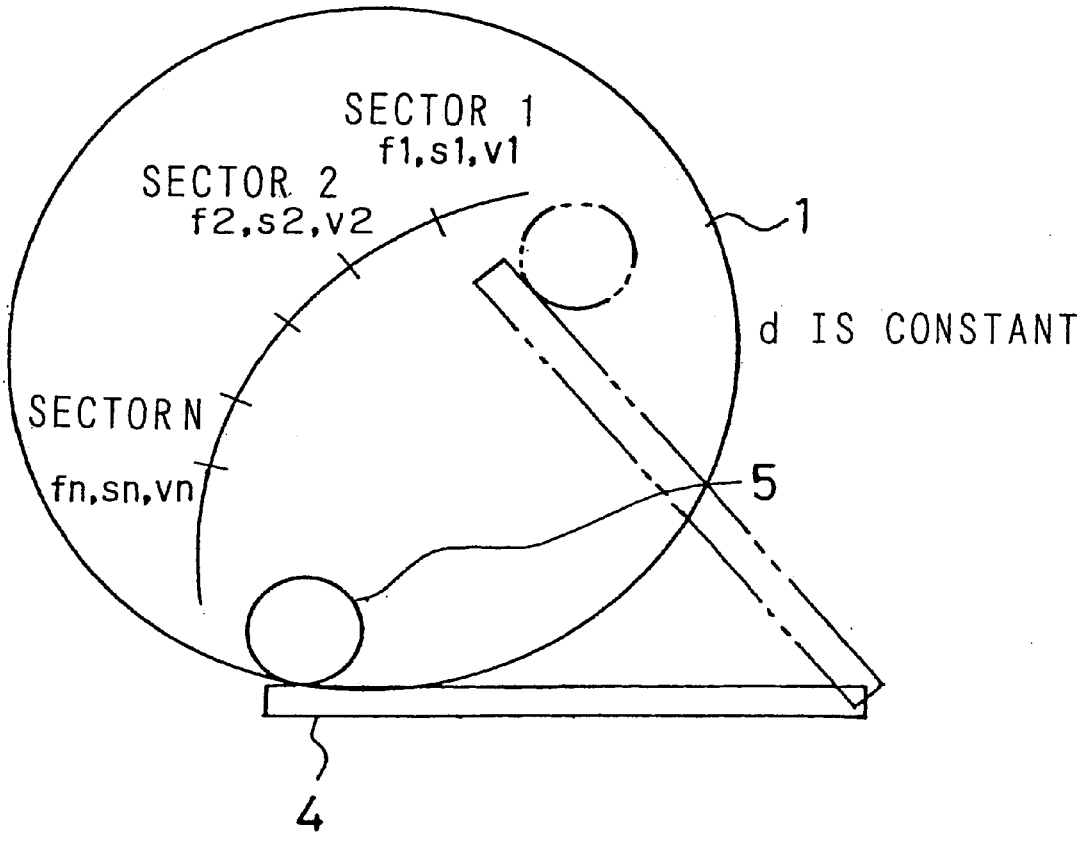
FIG. 6 is an explanatory view of a method for setting conditioning conditions for every sector of a polishing pad.

It is preferable to set the conditioning conditions particularly for every sector of the polishing pad. FIG. 6 is an explanatory view of a method for setting the conditioning conditions for every sector. In this figure, each of sector 1, sector 2, . . . , and sector n represents a divisional sector of the polishing pad; f, a conditioning load (load applied to a diamond disc 5); s, a number of revolution of the polishing table; v, a residence time of the diamond disc 5 on a sector. It is preferable to divide the surface of the polishing pad 1 into n pieces of sectors 1, 2, . . . , n according to the position of the polishing pad, partial properties of a substrate to be polished with reference to FIG. 6 and to set the conditioning parameters (f, s, v) for every sector.

The present invention is preferably applied to CMP, especially to polishing a wafer, or semi conductive substrate and multi-layered wiring substrate on which device pattern and/or film species such as metallic film, insulating film and the like are formed.

EXAMPLES

The examples of the present invention will be explained as follows with reference to the accompanying drawings.

Example 1

FIG. 1 is an explanatory view of a polishing apparatus of Example 1. As illustrated in FIG. 1, a polishing table 3 with a polishing pad 1 adhered thereto is rotated by a table motor 8. The number of revolution of the polishing table can be detected by an encoder 9 attached to the table motor 8. A signal corresponding to the detected number of revolution (signal corresponding to an actual number of revolution) output by the encoder 9 is input into one input terminal of a negative feedback amplifying circuit 11. Set number of revolution of the polishing table 3 is input into another reference input terminal of the negative feedback amplifying circuit. By the negative feedback amplifying circuit the actual number of revolution of the polishing table is compared with the set number of revolution and a torque current to be supplied to the table motor 8 is controlled so as to make the actual number of revolution approximate or equal to the set number of revolution.

A wafer 2 is held by a spindle 7 through a carrier above the polishing pad 1. In polishing the wafer 2 (run step), a slurry (containing an abrasive agent is fed on the polishing pad 1, the polishing table 3 and the spindle 7 are rotated, the wafer 2 is pressed onto the polishing pad 1 which is to be polished by an abrasive agent captured in traps existed on the surface of the polishing pad 1.

The polishing apparatus further includes a conditioning control system 12. The conditioning control system is composed of an input part into which a torque current detection signal is input from a torque current detection unit which is not shown in any figure, a memory unit which stores the value of the torque current detection signal, constant assigned in a formula representing the relation of the variation (difference) between the torque current detection signals and that of conditioning loads, a setting unit in which conditioning conditions are operated on the basis of the torque current detection signal and the constant stored in the memory unit, and an output part from which a control signal is output to a conditioning driving means 4 according to the set conditioning conditions. By the conditioning driving means 4 a diamond disc 5 which is a conditioning device is driven according to the input control signal. In conditioning, the diamond disc 5 sweeps the surface of the polishing pad 1 according to the set conditioning conditions.

Now, the principle of setting conditioning conditions will be explained as follows.

As indicated by the above formula (9), the difference between the (n−1)-th run and the n-th run of the maximum torque currents ΔIMAXn is proportional to the difference of maximum frictional forces $\Delta\mu$MAXn. Further, the difference of the maximum frictional forces is proportional to the difference of conditioning conditions (the following formula (10)).

$$\Delta IMAXn = constant \times \Delta\mu MAXn = constant \times \Delta fsvd \quad (10)$$

When s=C1, v=C2 and d=C3 in the formula (10) with proviso that C1, C2 and C3 are constant, and only f is variable, the formula (10) can be transformed as follows.

$$\Delta IMAXn = constant \times \Delta\mu MAXn = constant \times \Delta f \quad (11)$$

The formula (11) indicates that the relation of "$\Delta\mu$MAXn =constant×Δf" is established, and accordingly that the maximum torque current value IMAXn can be controlled to be mutually constant common through all of the runs by setting the conditioning load f.

Figure 7:
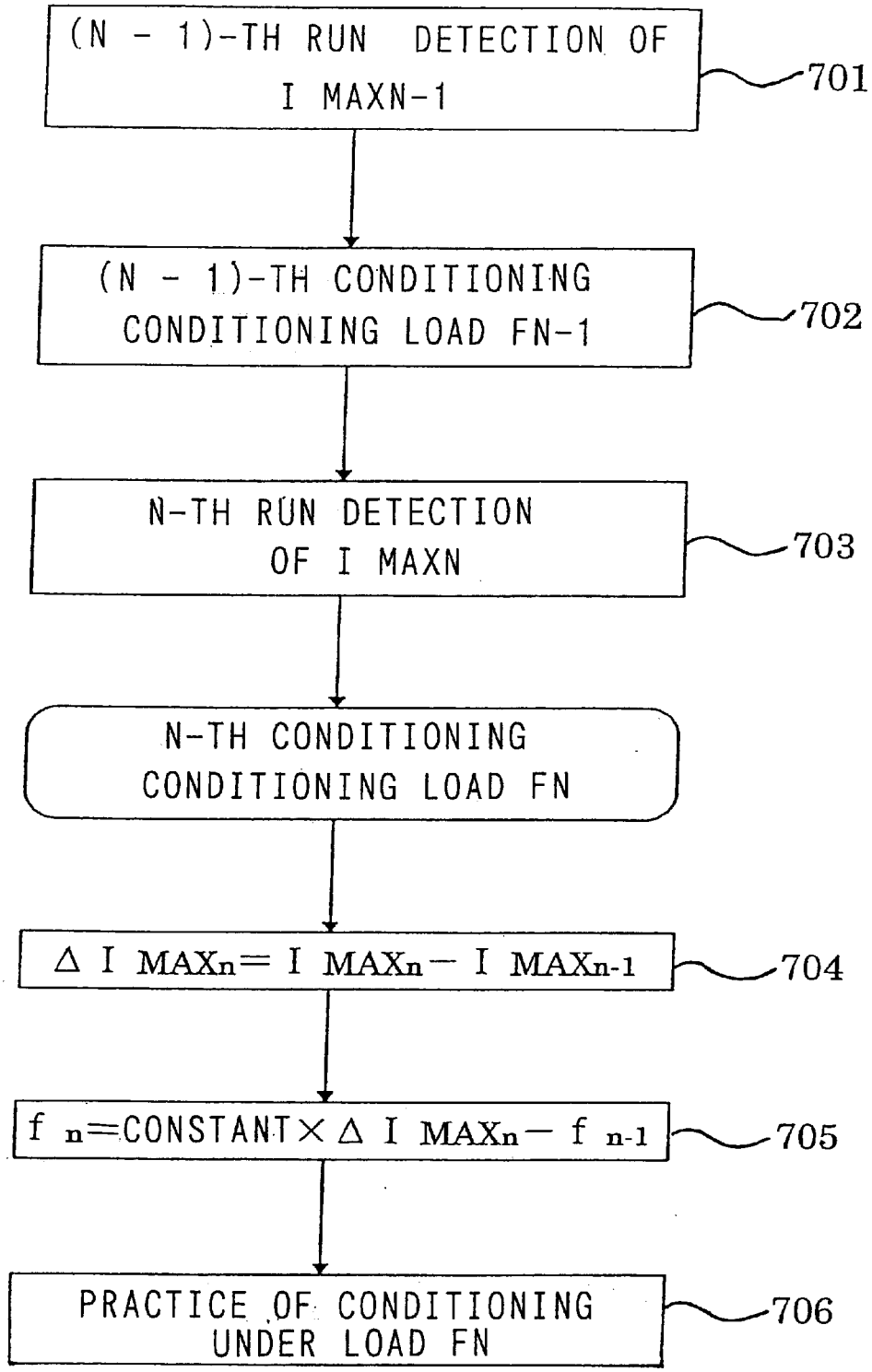
FIG. 7 is an explanatory view of an action of an exemplary polishing apparatus of the present invention.

Next, the operation of the conditioning control system will be explained as follows. FIG. 7 is an explanatory view of an operation for setting conditioning conditions in the polishing apparatus shown in FIG. 1. Referring to FIGS. 1 and 7, the (n −1)-th run is practiced by using the polishing apparatus. A maximum torque current value in the (n−1)-th run is detected by the conditioning control system 12 and stored in the same (step 702). After finishing the (n−1)-th run, (n−1)-th conditioning is performed while a conditioning load fn−1 is applied (step 702). After finishing the (n−1)-th conditioning, n-th run is practiced. The maximum torque current value in the n-th run is detected by the conditioning control system 12 and stored in the same (step 703).

After finishing the n-th run, a conditioning load in n-th conditioning is set by the conditioning control system 12. In this procedure, the difference between the (n−1)-th run and the n-th run of the maximum torque current values ΔIMAXn=IMAXn −IMAXn−1 is calculated at first (step 704). When the conditioning load is variable, other conditioning conditions are invariable, and the conditioning load of the n-th conditioning is fn, fn is determined by the above formula (11) as follows according to the following formula (step 705).

$$fn=constant\times\Delta IMAXn-fn-1 \quad (12)$$

The constant in the formula (12) can be determined beforehand by the relation of the conditioning load and the maximum torque current value. Accordingly, the conditioning load fn is determined by assigning the difference of the maximum torque currents and the conditioning load of the (n−1)-th conditioning into the formula (12), and then n-th conditioning is practiced under the thus determined conditioning load (step 706).

Figure 8:
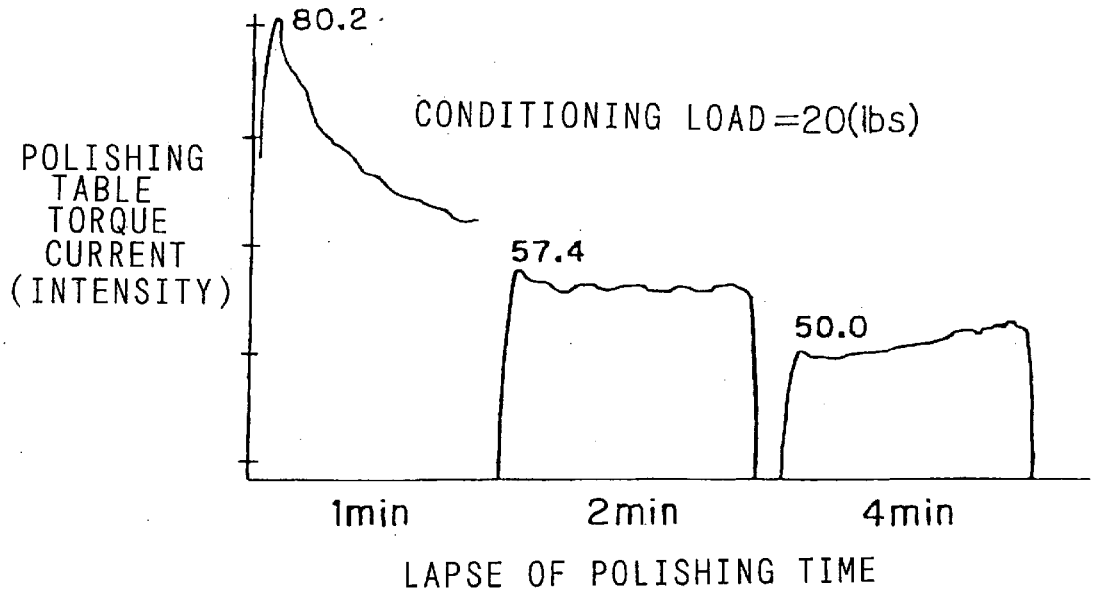
FIG. 8 is a graph showing the relation of the lapse of polishing time and torque current in a polishing step after conditioning (conditioning load: 20 lbs).
Figure 9:
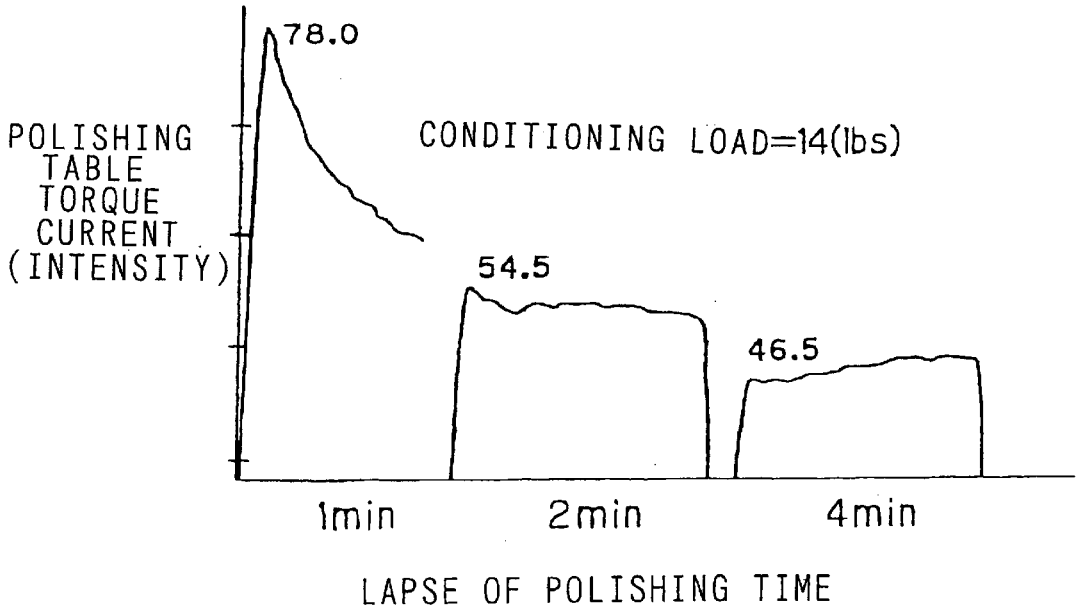
FIG. 9 is a graph showing the relation of the lapse of polishing time and torque current in a polishing step after conditioning (conditioning load: 14 lbs).

Next, the following experiment was carried out in order to make clear that a torque current during polishing the substrate can be controlled by changing the conditioning load. Namely, the torque current during polishing a wafer was measured after conditioning under the conditioning load of 20 lbs or 14 lbs. FIG. 8 is a graph showing the change of a torque current with time in a run (wafer polishing step) immediately after conditioning under the conditioning load of 14 (lbs). FIG. 9 is a graph showing the change of a torque current with lapse of time which is the same as that of FIG. 8 except that the conditioning load is 20 (lbs). Other experimental conditions are just as disclosed in the paragraph of the preferred embodiments of the invention.

Comparison of FIGS. 8 and 9 teaches that the maximum torque current value in a run immediately after conditioning becomes high in case that the conditioning load is large. Accordingly, it will be understood that the maximum torque current during polishing the substrate can be controlled to be constant in different runs from each other by controlling the conditioning load.

Figure 10:
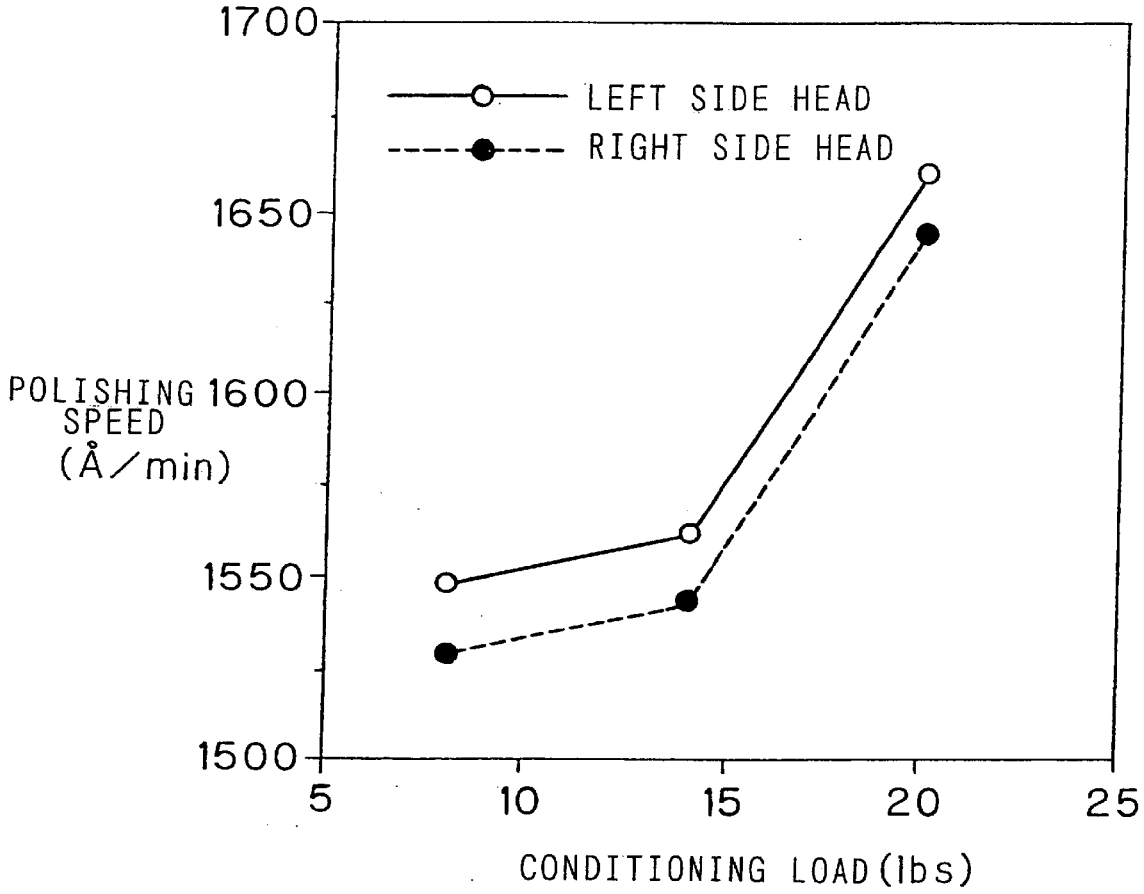
FIG. 10 is a graph showing the relation of a conditioning load and a polishing speed.

Further, a polishing speed was determined in the above experiment by measuring the thickness of a wafer after a given time lapsed from the start of polishing. FIG. 10 shows the relation of the conditioning load and a polishing speed in a run immediately after conditioning. In FIG. 10, a white circle represents data concerning a wafer mounted on the left side head of the polishing apparatus, and a black circle represents data concerning a wafer mounted on the right side head of the polishing apparatus.

FIG. 10 indicates that the polishing speed becomes high by increasing the conditioning load. Accordingly, it will be understood that the polishing speed can be controlled to be constant by controlling the conditioning load.

As shown in FIG. 10, the polishing speed of the wafer mounted on the left side head is different from that of the wafer mounted on the right side head. It is preferable to set conditioning conditions for every sector of the polishing pad taking the difference of a polishing speed due to such a position of the wafer mounted on the head into consideration.

Example 2

In Example 2 the relation of number of revolution of the polishing table during conditioning and wafer polishing speed in a run after conditioning was investigated under the condition that the number of revolution of the polishing table during polishing is variable and other conditioning conditions are invariable, although the conditioning load was variable in Example 1. Experimental conditions were the same of those in Example 1 except the number of revolution of the polishing table during conditioning. The result of the experiment is shown in FIG. 11.

Figure 11:
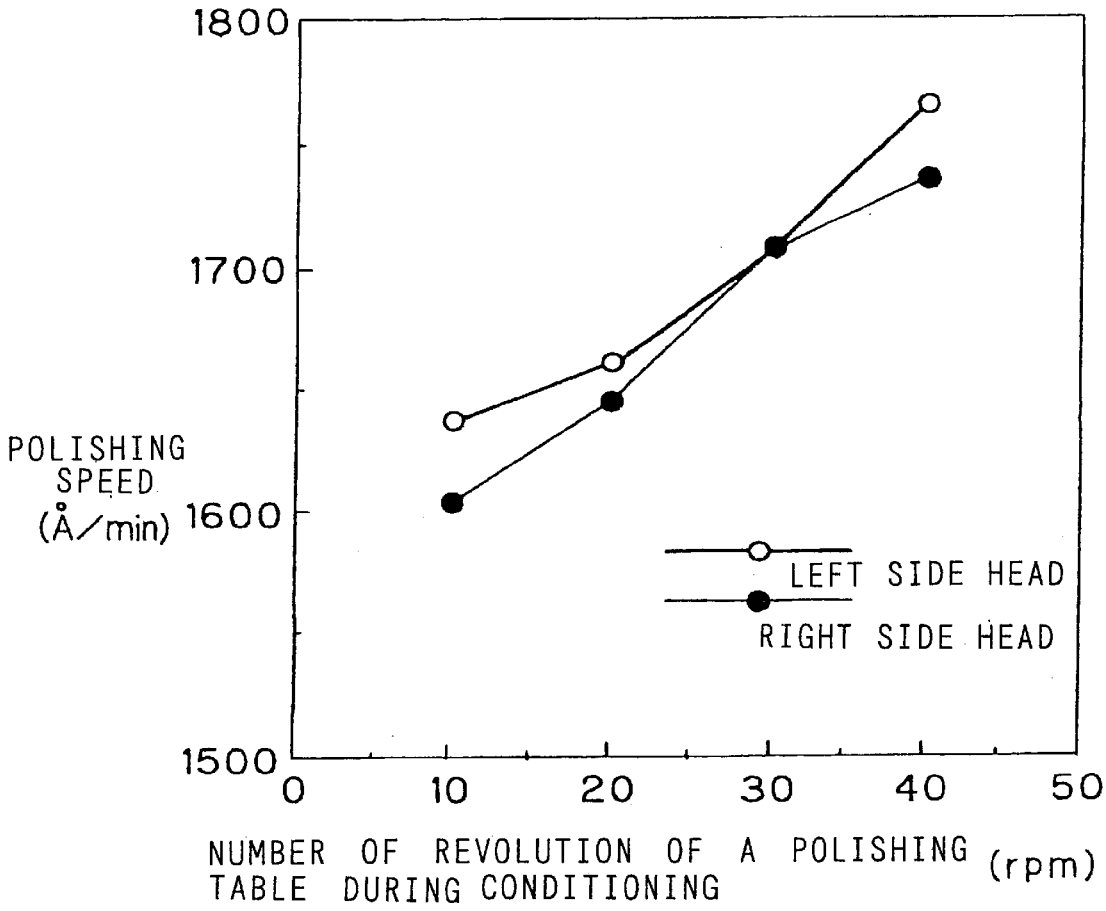
FIG. 11 is a graph showing the relation of the number of revolution of a polishing table during conditioning and a polishing speed.
Figure 12A:
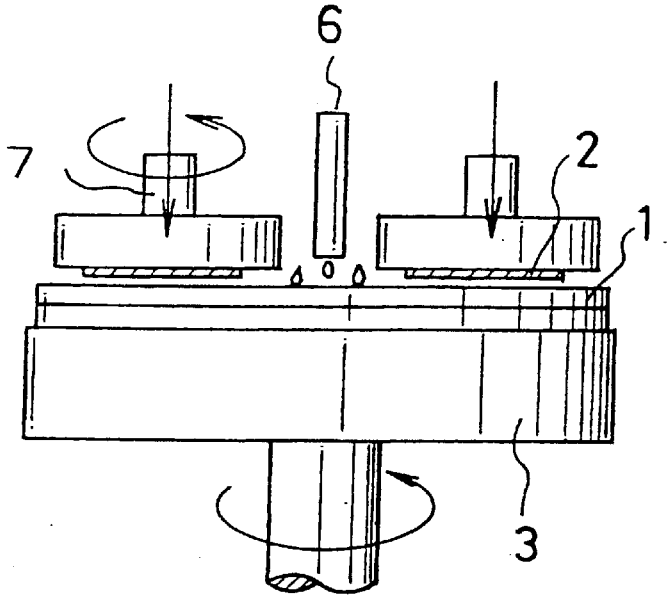
FIGS. 12(A) and (B) are an explanatory view of a conventional polishing apparatus.
Figure 12B:
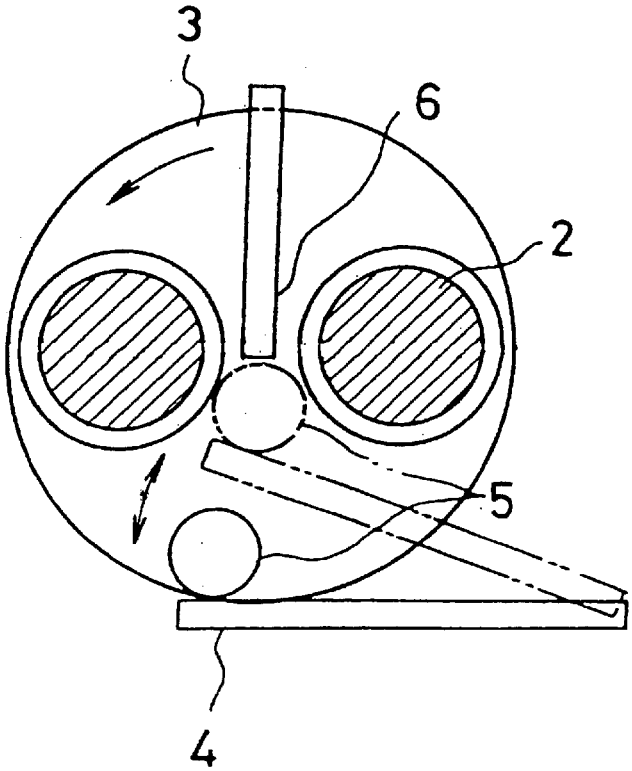
FIG. 12 (A) is a front view, and FIG. 12 (B) is a plan view.

FIG. 11 indicates that the number of revolution (rotational speed) of the polishing table during conditioning is in approximate proportion to the wafer polishing speed, and accordingly that the wafer polishing speed can be controlled to be constant by changing the number of revolution of the polishing table during conditioning.

Example 3

In this Example 3, total polished amount is controlled to be constant mutually throughout runs by controlling the sum (integrated value) of torque currents during run, although the maximum value of the torque current was controlled to beconstant in different runs from each other in Examples 1 and 2. Details of Example 3 will be explained as follows.

The following formula is derived from the above formulae (1), (2) and (7).

$$\text{Total polished amount during a period of polishing}=\int I(t)dt=constant\times\int fsvd\times r(t)dt \quad (12)$$

The formula (12) indicates that the total polished amount during the period is a function of "∫fsvd", and accordingly that the sum of the torque currents during the period, or the total polished amount can be controlled by changing conditioning conditions (f, s, v, d). The method of setting conditioning conditions disclosed in Example 3 can be also applied, for example, in the case that the change of the torque current during polishing does not exhibit linearity.

Meritorious effects achieved by the present invention are briefly mentioned.

According to the present invention, information for setting the conditions of conditioning which is practiced in the interval of polishing steps of a substrate to be changed into a product can be obtained from the polishing steps so that it is needless to carry out a pilot operation for setting the conditioning conditions between polishing steps (runs) of a product. Further, it is needless to take variation between lots, ununiformity of an abrasive agent and the difference between polishing apparatus into consideration. Moreover, the change of the polishing speed (rate) with lapse of the time can be avoided, and variation between lots regarding the substrate thickness and the surface state of the substrate can be reduced.

It should be noted that other objects of the present invention will become apparent in the entire disclosure and that modifications may be done without departing the gist and scope of the present invention as disclosed herein and appended herewith.

Also it should be noted that any combination of the disclosed and/or claimed elements, matters and/or items may fall under the modifications aforementioned.

What is claimed is:

1. A polishing apparatus which comprises:

a polishing device driven by a torque current and polishing a substrate;

a conditioning device which conditions said polishing device before polishing said substrate, and a conditioning control system which controls said conditioning device based on a torque current signal that corresponds to a frictional force exerted between said polishing device and said substrate during polishing said substrate.

2. The polishing apparatus as defined in claim 1, wherein said conditioning control system controls said conditioning device so as to make said frictional force constant.

3. The polishing apparatus as defined in claim 1, which further comprises a torque current detection unit that conveys said torque current signal to said conditioning control system, wherein said conditioning is performed between steps of polishing said substrate, and said conditioning control system comprises a setting unit that sets conditioning conditions so as to make a maximum of said torque current constant throughout said polishing steps based on a detection signal input from said torque current detection unit.

4. The polishing apparatus as defined in claim 1, which further comprises a torque current detection unit that conveys said torque current signal to said conditioning control system, wherein said conditioning is performed between steps of polishing said substrate, and said conditioning control system comprises a setting device which sets conditioning conditions so as to keep a sum of said torque current flowing during polishing said substrate constant throughout said polishing steps based on a detection signal input from said torque current detection unit.

5. The polishing apparatus of claim 1, wherein said conditioning control system determines an end of polishing by setting conditioning conditions to keep an integral of the torque current over a polishing run to be a constant.

6. A polishing apparatus which comprises a polishing device polishing a substrate, a conditioning device which conditions said polishing device before polishing said substrate and a conditioning control system which controls said conditioning device based on a frictional force exerted between said polishing device and said substrate during polishing said substrate, wherein conditioning conditions are set by a setting unit based on one or more parameters selected from a group of parameters consisting of conditioning load of said conditioning device working on said polishing device, number of revolutions of said polishing device during conditioning, conditioning time, and surface roughness of said conditioning device.

7. The polishing apparatus as defined in claim 6, wherein said setting unit sets a conditioning load based on a difference between maximum torque currents observed in separate said polishing steps and further based on a conditioning load of a last one of the polishing steps.

8. A polishing apparatus which comprises a polishing device polishing a substrate, a conditioning device which conditions said polishing device before polishing said substrate and a conditioning control system which controls said conditioning device based on a frictional force exerted between said polishing device and said substrate during polishing said substrate, wherein said polishing device comprises a polishing table with a polishing pad adhered thereto on which traps for capturing abrasive grains or debris are formed, and a relation of frictional force $\mu(t)$ after t hours lapsed from the start of polishing and conditioning conditions is represented by the following formula:

$$\mu(t)=n\times h\times X\times r(t)$$

where n is number of traps existed on said polishing pad, h is depth of said trap, X is width of said traps, r(t) is an effective trap ratio which contributes to polishing and corresponds to value which decreases with lapse of time due to gradual loading of debris in said traps.

9. A polishing method which comprises the steps of:

detecting a frictional force exerted between a polishing device and a substrate during each of plural steps of polishing said substrate; and conditioning said polishing device between consecutive ones of said polishing steps based on said frictional force detected, wherein for each sector of the polishing device during each said conditioning step, a conditioning load applied to the polishing device and a length of time of application of the conditioning load are functions of the detected frictional force.

10. The method of claim 9, wherein a length of time of application of the conditioning load and a rotational speed of the polishing device are the same for each sector of the polishing device.

11. A polishing method which comprises the steps of:

detecting a torque current for driving a polishing device polishing a substrate during polishing said substrate;

conditioning said polishing device based on said torque current; and advancing a subsequent step of polishing said substrate.

12. The polishing method of claim 10, further comprising the step of setting conditioning conditions during a polishing run to keep constant an integral of the torque current during the polishing run.

13. The polishing method as defined in claim 11, further comprising the steps of:

detecting a maximum value of said torque current in polishing steps of polishing a substrate, and setting conditioning conditions based on a variation of said maximum torque currents observed in said polishing steps and further based on the conditioning conditions of a preceding polishing step.

* * * * *